US010277983B2

(12) United States Patent
Yoo

(10) Patent No.: US 10,277,983 B2
(45) Date of Patent: Apr. 30, 2019

(54) MICROPHONE DEVICE

(71) Applicants: HYUNDAI MOTOR COMPANY, Seoul (KR); KIA MOTORS CORPORATION, Seoul (KR)

(72) Inventor: Ilseon Yoo, Suwon-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 15/821,333

(22) Filed: Nov. 22, 2017

(65) Prior Publication Data

US 2019/0082261 A1 Mar. 14, 2019

(30) Foreign Application Priority Data

Sep. 13, 2017 (KR) ..... 10-2017-0117086

(51) Int. Cl.

| | |
|---|---|
| ***H04R 3/00*** | (2006.01) |
| ***H04R 7/16*** | (2006.01) |
| ***H04R 1/04*** | (2006.01) |
| ***H04R 7/10*** | (2006.01) |
| ***H04R 19/00*** | (2006.01) |
| ***H04R 19/04*** | (2006.01) |
| ***H04R 7/26*** | (2006.01) |

(52) U.S. Cl.

CPC ..... *H04R 7/16* (2013.01); *H04R 1/04* (2013.01); *H04R 7/10* (2013.01); *H04R 7/26* (2013.01); *H04R 19/005* (2013.01); *H04R 19/04* (2013.01); *H04R 2307/207* (2013.01)

(58) Field of Classification Search

CPC ..... H04R 3/00

See application file for complete search history.

(56) References Cited

U.S. PATENT DOCUMENTS

| | | | | |
|---|---|---|---|---|
| 9,674,627 | B2 * | 6/2017 | Hsu | H04R 31/006 |
| 2006/0210106 | A1 * | 9/2006 | Pedersen | B81B 3/0072 381/355 |
| 2010/0038733 | A1 * | 2/2010 | Minervini | B81B 7/0048 257/416 |
| 2016/0219378 | A1 * | 7/2016 | Hall | H04R 23/02 |
| 2016/0227330 | A1 * | 8/2016 | Okugawa | H04R 19/005 |
| 2017/0181271 | A1 * | 6/2017 | Yee | H05K 1/0271 |
| 2018/0029880 | A1 * | 2/2018 | Lim | B81B 7/007 |
| 2018/0048951 | A1 * | 2/2018 | Zheng | H04R 1/04 |
| 2018/0050902 | A1 * | 2/2018 | Sun | B81B 7/02 |
| 2018/0146296 | A1 * | 5/2018 | Meisel | H04R 9/08 |
| 2018/0148321 | A1 * | 5/2018 | Duqi | B81B 3/0051 |

* cited by examiner

*Primary Examiner* — Olisa Anwah

(74) *Attorney, Agent, or Firm* — Lempia Summerfield Katz LLC

(57) ABSTRACT

A microphone apparatus is disclosed. A microphone apparatus according to an exemplary embodiment includes a vibration membrane disposed inside a case and formed on an upper surface of a main substrate; an acoustic component including an absorbing unit cut over a predetermined section toward the outside of a fixed membrane and having a predetermined pattern; a microphone module including a semiconductor chip electrically connected to the acoustic component inside the case; and a printed circuit board on which the microphone module is mounted.

15 Claims, 3 Drawing Sheets

MICROPHONE DEVICE

CROSS-REFERENCE TO RELATED APPLICATION

This application claims priority to and the benefit of Korean Patent Application No. 10-2017-0117086, filed in the Korean Intellectual Property Office on Sep. 13, 2017, the entire contents of which are incorporated herein by reference.

BACKGROUND

(a) Field

The present disclosure is related to a microphone device and more particularly, a microphone device configured to prevent deformation of a vibration membrane that occurs when a microphone module is mounted on a printed circuit board.

(b) Description of the Related Art

In general, a microphone is a device converting an external voice signal into an electrical signal. Microphones may be used for communication devices such as mobile phones, MP3 players, and telephones and medical devices such as hearing aids; embedded in down-sized multi-functional smart sensors; or used for small precision devices.

Because the manufacturing of microphones involves a mechanical fabrication process, physical limitations are present in ultra-downsizing the microphones in the order of millimeter down to micrometer unit.

However, along with accelerated downsizing of audio devices or information communication devices in which microphones are installed, ultra-downsizing of microphones is furthermore demanded.

Recently, in order to overcome physical limitations in ultra-downsizing and mass production of the microphones, MEMS microphones employing the Micro Electro Mechanical System (MEMS) technology, which forms a direct capacitive structure on a silicon wafer by using a semiconductor manufacturing technology, is being developed actively.

MEMS microphones are getting great attention in terms of performance and production efficiency because they may be ultra-downsized, and separate production processes for different components may be handled in an integrated batch process.

MEMS microphones are manufactured by applying semiconductor processing technology using Surface Mount Technology (SMT) and MEMS technology.

At this time, SMT refers to the technology that prints solder paste such as lead on a Printed Circuit Board (PCB), mounts various surface mount devices (SMDs) on the PCB by using mounter equipment, and passes them through a reflow machine to bond the leads of electronic components and the PCB together.

MEMS microphones may be used to simplify manufacturing of microphones or downsize the microphones by mounting electronic circuit components such as MEMS die, amplifiers, and filters on the PCB by using SMT.

In addition, MEMS technology may be used for bulk processing of silicon wafers, structure layer processing, surface micromachining, thin film processing, homogeneous or heterogeneous substrate joining, and three-dimensional (3D) structure molding using micromachining technology applying a semiconductor process, particularly, integrated circuit technology to fabricate ultra-small sensors, actuators, and electro-mechanical structures in the order of micrometer unit.

SMT and MEMS technology have enabled production of transducers, namely MEMS die with diaphragm, which are a core component for ultra-small and high-performance MEMS microphones.

Manufacturing of PCBs employing the MEMS die and SMT not only enables ultra-downsizing of microphones but also simplifies various processes involved in packaging of MEMS microphones, thereby greatly increasing productivity.

However, when the MEMS microphone package is mounted on the PCB by a surface mounting process, metal bonding of the PCB and the MEMS microphone is performed at a high temperate ranging from 230° C. to 270° C. When the components that expanded during the bonding process at a high temperature return to the room temperature, deformation occurs from the difference between thermal expansion coefficients due to the thickness difference of substrates.

The resulting residual stress causes deformation of the vibration membrane of the MEMS microphone, thereby deteriorating the sensitivity.

The above information disclosed in this Background section is only for enhancement of understanding of the background and therefore it may contain information that does not form the prior art that is already known in this country to a person of ordinary skill in the art.

SUMMARY

An exemplary embodiment of the present disclosure provides a microphone apparatus that prevents the vibration membrane from being deformed by absorbing variation of shrinkage of substrates caused when a microphone module is mounted on a printed circuit board through an absorbing unit being separated along the circumference of the vibration membrane of the microphone module.

In one or a plurality of exemplary embodiments, a microphone apparatus includes a vibration membrane disposed inside a case and formed on an upper surface of a main substrate; an acoustic component including an absorbing unit cut over a predetermined section toward the outside of a fixed membrane and having a predetermined pattern; a microphone module including a semiconductor chip electrically connected to the acoustic component inside the case; and a printed circuit board on which the microphone module is mounted.

Also, the embodiment may include a lower case in which the acoustic component and the semiconductor chip are electrically connected with each other; and an upper case forming a receiving space accommodating the acoustic component and the semiconductor chip in an upper portion of the lower case.

Also, the acoustic component may include a main substrate forming a bonding step cut over a predetermined section along an edge of a lower surface while an acoustic hole being formed corresponding to a penetration hole on the lower case; a vibration membrane formed in an upper portion of the main substrate corresponding to the acoustic hole; a driving membrane disposed being separated from an upper portion of the vibration membrane; and an absorbing unit having a predetermined pattern, the absorbing unit including a plurality of slits along a circumference of the vibration membrane and the driving membrane on the main substrate.

Also, the absorbing unit may include a space with a predetermined pattern encapsulating the vibration membrane to prevent the vibration membrane from being deformed according to deformation of the main substrate at a high temperature when the microphone module is mounted on the printed circuit board.

Also, the predetermined pattern of the absorbing unit includes a straight-line unit formed by a plurality of straight-line slits penetrating a main substrate and disposed in parallel outwards being separated in four directions of the vibration membrane and the fixed membrane to encapsulate the vibration membrane and the fixed membrane; and a connecting unit connecting both ends of the plurality of straight-line slits selectively between the neighboring straight-line units.

Also, the predetermined pattern of the absorbing unit includes a straight-line unit formed by one penetrating straight-line slit separated in four directions from the vibration membrane and the fixed membrane to encapsulate the vibration membrane and the fixed membrane, both ends of which extending outwards; and a connecting unit formed by being separated from the neighboring straight-line units along the shape of each end of the straight-line slit.

Also, the acoustic component may be bonded to the lower case by spraying the adhesive through the bonding step.

Also, the printed circuit board may form an inflow hole connected with a penetration hole of the lower case.

In addition to the aforementioned advantageous effect, an effect that may be obtained or anticipated by applying an exemplary embodiment will be disclosed explicitly or implicitly in the detailed description of the exemplary embodiment. In other words, various effects expected by applying an exemplary embodiment will be disclosed within the detailed description to be provided later.

An exemplary embodiment prevents the vibration membrane from being deformed by absorbing variation of shrinkage of substrates caused when a microphone module is mounted on a printed circuit board through an absorbing unit formed being separated along the circumference of the vibration membrane of the microphone module.

Accordingly, an exemplary embodiment may maintain sensitivity of a microphone module by preventing deformation of a vibration membrane when the microphone module is mounted on a printed circuit board.

DETAILED DESCRIPTION

Figure 1:
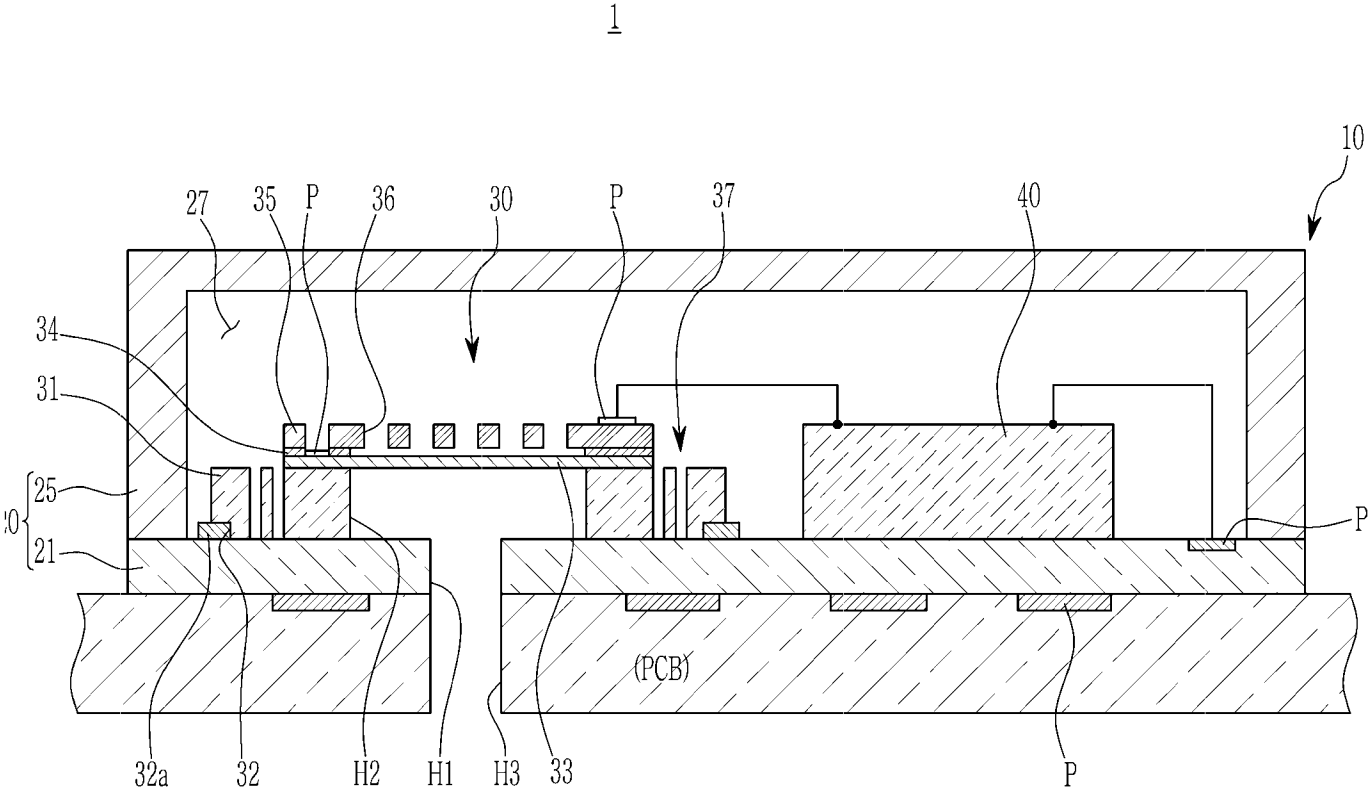
FIG. 1 is a schematic diagram of a microphone apparatus according to an exemplary embodiment.

The present disclosure will be described more fully hereinafter with reference to the accompanying drawings, in which exemplary embodiments are shown. As those skilled in the art would realize, the described embodiments may be modified in various different ways, all without departing from the spirit or scope of the present disclosure.

The drawings and description are to be regarded as illustrative in nature and not restrictive. The same reference numerals are applied for the same or similar constituent elements throughout the specification. The following is a list of reference symbols and corresponding descriptions as used in the specification and the drawings.

1: microphone apparatus
10: microphone module
20: case
21: lower case
H1: penetration hole
25: upper case
27: receiving space
30: acoustic component
P: electrode pad
31: main substrate
H2: acoustic hole
32: bonding step
32*a*: adhesive
33: vibration membrane
34: supporting layer
35: driving membrane
36: air passage
37: absorbing unit
37*a*: straight line unit
37*b*: connecting unit
40: semiconductor chip
PCB: printed circuit board
H3: inflow hole In the following description, dividing names of components into first, second and the like is to divide the names because the names of the components are the same as each other and an order thereof is not particularly limited.

Figure 2A:
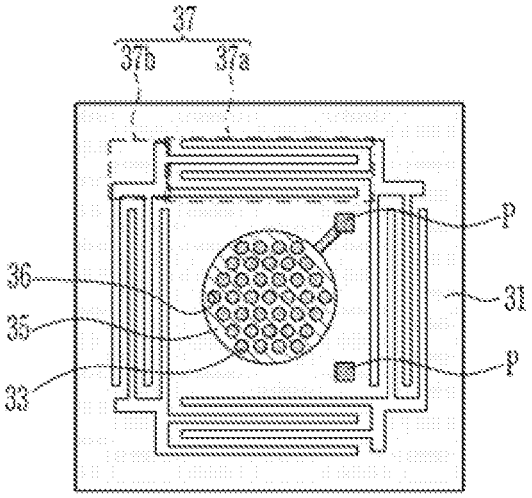
FIGS. 2A and 2B depict top plan views of an acoustic component applied to a microphone apparatus according to exemplary embodiments.
Figure 2B:
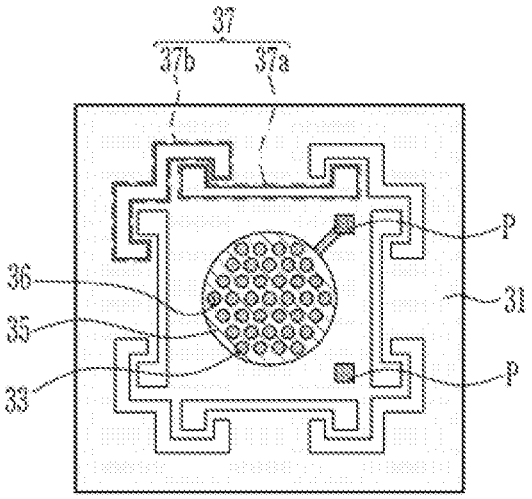

FIG. 1 is a schematic diagram of a microphone apparatus according to an exemplary embodiment, and FIGS. 2A and 2B depict top plan views of an acoustic component applied to a microphone apparatus according to exemplary embodiments.

Referring to FIG. 1, a microphone apparatus 1 according to an exemplary embodiment includes a microphone module 10 and a printed circuit board (PCB).

The microphone module 10 converts acoustic energy into electric energy.

In other words, the microphone module 10 is surface-mounted on a signal terminal of the PCB embedded in an electronic device, forms an electric connection to the PCB, and thereby converts acoustic energy into electric energy.

The microphone module 10 includes a case 20, acoustic component 30, and semiconductor chip 40.

The case 20 includes a lower case 21 and an upper case 25.

In other words, the case 20 includes the lower case 21 in which the acoustic component 30 and the semiconductor chip 40 are connected electrically.

On the lower case 21, an electrode pad P is formed, by which the acoustic component 30 and the semiconductor chip 40 are electrically connected.

Also, a penetration hole H1 is formed penetrating the lower case 21, through which an inflow of sound is made.

Also, the case 20 includes an upper case 25 forming a receiving space 27 accommodating the acoustic component 30 and the semiconductor chip 40 in an upper portion of the lower case 21.

The upper case 25 is bonded to the lower case 21 along the circumference of the upper surface of the lower case 21.

The acoustic component 30 is disposed inside the case 20.

In other words, the acoustic component 30 is bonded to the upper surface of the lower case 21, while being disposed on the receiving space 27 of the upper case 25.

The acoustic component 30 includes a main substrate 31, vibration membrane 33, driving membrane 35, and absorbing membrane 37.

An acoustic hole H2 is formed in the central portion of the main substrate 31.

The acoustic component 30 is disposed at the position corresponding to the acoustic hole H2 with respect to the penetration hole H1 of the lower case 21.

The acoustic hole H2 is a passage through which an inflow of a sound source generated from an external acoustic processor (not shown) is made to vibrate the vibration membrane 33.

Here, the acoustic processor processes the user's voice and corresponds to at least one of a voice recognition device, hands-free device, and portable communication terminal.

The voice recognition device recognizes a voice command from the user and performs a function corresponding to the voice command.

Also, the hands-free device, being connected with a portable communication terminal through short-range wireless communication, enables the user to use the portable communication terminal freely without using the hands of the user.

Also, the portable communication terminal is a device allowing the user to communicate wirelessly and may include a smartphone and a personal digital assistant (PDA).

In a lower surface of the main substrate 31, a bonding step 32 is formed.

The bonding step 32 is formed by cutting out a predetermined section along the edge of the main substrate 31.

The bonding step 32 is intended to accommodate the adhesive 32*a* to bond the main substrate 31 to the lower case 21.

The main substrate 31 is made of a silicon wafer.

The vibration membrane 33 is formed on the upper surface of the main substrate 31.

The vibration membrane 33 is formed on an upper portion corresponding to the acoustic hole H2.

When an external sound source flows in through the acoustic hole H2, the vibration membrane 33 vibrates according to the inflow of the sound source.

The vibration membrane 33 may be made of poly-silicon material. However, the present disclosure is not necessarily limited to the exemplary embodiment, and any material with conductivity may be applied instead.

The driving membrane 35 is formed being separated from the vibration membrane 33 at the upper portion thereof 33.

The driving membrane 35 is bonded by being supported by the supporting layer 34 formed along the upper edge of the vibration membrane 33.

Also, a plurality of air passages 36 are formed in the driving membrane 35.

The plurality of air passages 36 are a passage through which air flows.

The driving membrane 35 may be made of poly-silicon material in the same manner as the vibration membrane 33. However, the present disclosure is not necessarily limited to the exemplary embodiment, and any material with conductivity may be applied instead.

Referring to FIGS. 2A and 2B, the acoustic component 30 includes an absorbing unit 37 with a predetermined pattern, the absorbing unit being formed penetrating along the circumference of the vibration membrane 33 and the driving membrane 35 on the main substrate 31.

The absorbing unit 37 includes a space with a predetermined pattern encapsulating the vibration membrane 33 and the fixed membrane 35, the space being separated from the vibration and the fixed membrane by a predetermined distance.

The absorbing unit 37 of FIG. 2A, according to a first exemplary embodiment, includes a plurality of straight-line slits formed penetrating along the circumference of the vibration membrane 33 and the driving membrane 35 on the main substrate 31.

In other words, the absorbing unit 37 is formed to penetrate in four directions being separated from the vibration membrane 33 and the fixed membrane 35 so as to encapsulate the vibration membrane 33 and the fixed membrane 35.

The absorbing unit 37 according to a first exemplary embodiment is divided into a straight-line unit 37*a* and a connecting unit 37*b*.

The straight-line unit 37*a* includes four straight-line slits disposed in parallel to each other outwards from a position adjacent to the vibration membrane 33 and the driving membrane 35.

Four such straight-line units 37*a* are formed in four directions toward the outside of the vibration membrane 33 and the fixed membrane 35.

Also, a connecting unit 37*b* is formed between each pair of adjacent straight-line units to connect each straight-line unit 37*a* to the other.

The connecting unit 37*b* is connected selectively with each straight-line slit of an adjacent straight-line unit 37*a*.

The absorbing unit 37 of FIG. 2B according to a second exemplary embodiment is formed to penetrate in four directions being separated from the vibration membrane 33 and the fixed membrane 35 so as to encapsulate the vibration membrane 33 and the fixed membrane 35.

The absorbing unit 37 according to the second exemplary embodiment is divided into a straight-line unit 37*a* and a connecting unit 37*b*.

The straight-line unit 37*a*, according to the second exemplary embodiment, includes one straight-line slit formed in four directions of the vibration membrane 33 and the fixed membrane 35.

In other words, four straight-line units 37*a* are formed to the outside of the vibration membrane 33 and the fixed membrane 35.

Both ends of the straight-line slit are formed being extended toward the outside.

Also, the connecting unit 37*b* is formed being separated along the shape of each step portion of the adjacent straight-line unit 37*a*.

Because mounting of the microphone module 10 on the PCB by using the SMT involves soldering at a high temperature, the absorbing unit 37 according to the first and the second exemplary embodiments is intended to prevent the vibration membrane 33 from being deformed due to expansion and contraction of the PCB, lower case 21, and main substrate 31.

In other words, the absorbing unit 37 forms a predetermined space to absorb the amount of deformation of the PCB, lower case 21, and main substrate 31, thereby protecting the vibration membrane 33.

Meanwhile, the microphone module 10 is mounted on the PCB.

In the PCB, an inflow hole H3 connected with the penetration hole H1 of the lower case 21 is formed.

Also, the PCB includes a contact pad P electrically connected with the microphone module 10.

Figure 3:
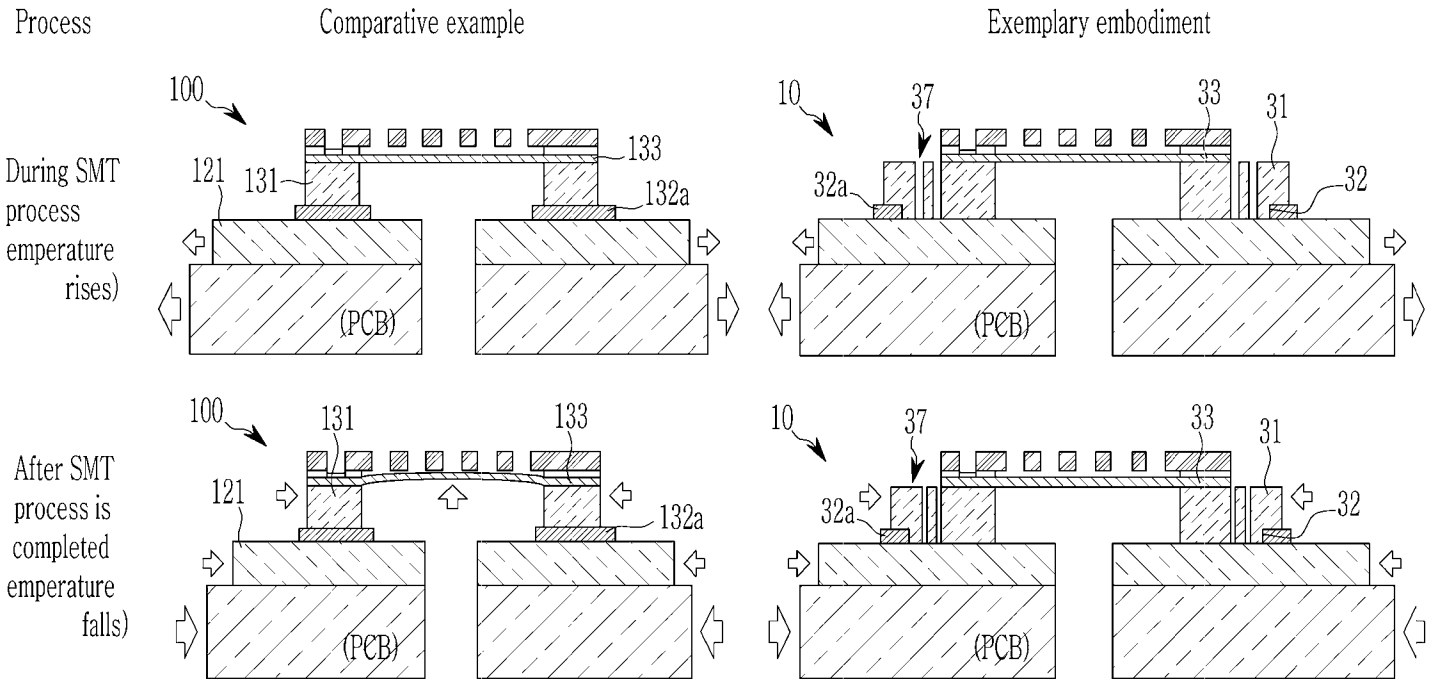
FIG. 3 compares phenomena observed when processing a microphone apparatus according to an exemplary embodiment and a microphone apparatus according to a comparative embodiment.

FIG. 3 is an enlarged view of portions of microphone apparatus, comparing phenomena observed when processing a microphone apparatus according to an exemplary embodiment and a microphone apparatus according to a comparative embodiment.

The absorbing unit of FIG. 3 according to an exemplary embodiment is briefly described independently of the first and second exemplary embodiments for the convenience of description.

The microphone module 10, 100, being disposed on the upper surface of the PCB, is mounted through lead welding.

When the microphone module 10, 100 is mounted on the PCB, the mounting process is performed at a high temperature of about 250° C.

Afterwards, when the microphone module returns to the room temperature, due to the difference in thickness among the PCB, the lower case 21, 121, and the main substrate 31, 131, each substrate is contracted.

Referring to FIG. 3, as each of the substrates 121, 131 is contracted, vibration membrane 133 according to a comparative example is also deformed, the central portion of which is deformed convexly in an upward direction.

Meanwhile, an exemplary embodiment absorbs the deformation due to contraction of each substrate (PCB, 21, 31) through the absorbing unit 37 formed on the main substrate 31, thereby preventing the vibration membrane 33 from being deformed.

In other words, the exemplary embodiment may maintain sensitivity even when a microphone module 10 is mounted on the PCB by preventing deformation of the vibration membrane 33.

In addition, in the comparative example, the adhesive 131*a* is applied over the whole lower surface of the main substrate 131 to bond the lower case 121 thereto 131, while, in an exemplary embodiment, a bonding step 32 is formed along the lower edge of the main substrate 31, and the adhesive 32*a* is applied to the bonding step 32 to bond the lower case 21 thereto 32, thereby minimizing the effect according as the adhesive 32*a* is melted at a high temperature.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A microphone apparatus comprising:

a microphone module disposed inside a case and having an acoustic component and a semiconductor chip electrically connected to the acoustic component inside the case, wherein the acoustic component has an absorbing unit; and a printed circuit board on which the microphone module is mounted, wherein the absorbing unit is cut over a predetermined section toward the outside of a fixed membrane and a vibration membrane, has a predetermined pattern, and comprises a plurality of slits along a circumference of the vibration membrane and the fixed membrane, wherein the fixed membrane and the vibration membrane are provided in an upper portion of a main substrate, and wherein the main substrate included in the acoustic component has a bonding step cut over a predetermined section along an edge of a lower surface of the main substrate while an acoustic hole is provided corresponding to a penetration hole on a lower case included in the case.

2. The microphone apparatus of claim 1, wherein the case comprises:

the lower case in which the acoustic component and the semiconductor chip are electrically connected with each other; and an upper case providing a receiving space accommodating the acoustic component and the semiconductor chip in an upper portion of the lower case.

3. The microphone apparatus of claim 2, wherein the acoustic component comprises:

the vibration membrane provided in an upper portion of the main substrate corresponding to the acoustic hole; and the fixed membrane separately disposed from an upper portion of the vibration membrane.

4. The microphone apparatus of claim 3, wherein the absorbing unit comprises a space with the predetermined pattern encapsulating the vibration membrane to prevent the vibration membrane from being deformed according to deformation of the main substrate at a high temperature when the microphone module is mounted on the printed circuit board.

5. The microphone apparatus of claim 4, wherein the predetermined pattern of the absorbing unit comprises:

a straight-line unit provided by a plurality of straight-line slits penetrating a main substrate and outwardly disposed, the plurality of straight-line slits being separated in four directions of the vibration membrane and the fixed membrane to encapsulate the vibration membrane and the fixed membrane; and a connecting unit connecting both ends of the plurality of straight-line slits selectively between the neighboring straight-line units.

6. The microphone apparatus of claim 4, wherein the predetermined pattern of the absorbing unit comprises:

a straight-line unit formed by one penetrating straight-line slit separated in four directions from the vibration membrane and the fixed membrane to encapsulate the vibration membrane and the fixed membrane, both ends of the straight-line slit extending outwards; and a connecting unit separate from the neighboring straight-line units along a shape of each end of the straight-line slit.

7. The microphone apparatus of claim 4, wherein the acoustic component is bonded to the lower case by an adhesive applied to the bonding step.

8. The microphone apparatus of claim 2, wherein the predetermined pattern of the absorbing unit comprises:

a straight-line unit provided by a plurality of straight-line slits penetrating a main substrate and outwardly disposed, the plurality of straight-line slits being separated in four directions of the vibration membrane and the fixed membrane to encapsulate the vibration membrane and the fixed membrane; and a connecting unit connecting both ends of the plurality of straight-line slits selectively between the neighboring straight-line units.

9. The microphone apparatus of claim 2, wherein the predetermined pattern of the absorbing unit comprises:

a straight-line unit formed by one penetrating straight-line slit separated in four directions from the vibration membrane and the fixed membrane to encapsulate the vibration membrane and the fixed membrane, both ends of the straight-line slit extending outwards; and a connecting unit separate from the neighboring straight-line units along a shape of each end of the straight-line slit.

10. The microphone apparatus of claim 1, wherein the acoustic component is bonded to the case by an adhesive applied to the bonding step.

11. The microphone apparatus of claim 1, wherein the absorbing unit has a space with a predetermined pattern encapsulating the vibration membrane, wherein the vibration membrane is provided in an upper portion of the main substrate, and wherein the absorbing unit is configured to prevent the vibration membrane from being deformed according to deformation of the main substrate at a high temperature when the microphone module is mounted on the printed circuit board.

12. The microphone apparatus of claim 1, wherein the predetermined pattern of the absorbing unit comprises:

a straight-line unit provided by a plurality of straight-line slits penetrating the main substrate and outwardly disposed, the plurality of straight-line slits being separated in four directions of the vibration membrane and the fixed membrane to encapsulate the vibration membrane and the fixed membrane; and a connecting unit connecting both ends of the plurality of straight-line slits selectively between the neighboring straight-line units.

13. The microphone apparatus of claim 1, wherein the predetermined pattern of the absorbing unit comprises:

a straight-line unit formed by one penetrating straight-line slit separated in four directions from the vibration membrane and the fixed membrane to encapsulate the vibration membrane and the fixed membrane, both ends of the straight-line slit extending outwards; and a connecting unit separate from the neighboring straight-line units along a shape of each end of the straight-line slit.

14. The microphone apparatus of claim 3, wherein the acoustic component is bonded to the lower case by an adhesive applied to the bonding step.

15. The microphone apparatus of claim 2, wherein the printed circuit board comprises an inflow hole connected with a penetration hole of the lower case.

* * * * *